United States Patent [19]

Washington et al.

[11] 4,422,005

[45] Dec. 20, 1983

[54] CHANNEL PLATE ELECTRON MULTIPLIER

[75] Inventors: Derek Washington, Wallington; Alan G. Knapp, Crawley, both of England

[73] Assignee: U.S. Philips Corporation, New York, N.Y.

[21] Appl. No.: 278,128

[22] Filed: Jun. 29, 1981

[30] Foreign Application Priority Data

Jul. 9, 1980 [GB] United Kingdom ..... 8022539

[51] Int. Cl.[3] ..... H01J 43/22

[52] U.S. Cl. ..... 313/105 CM; 313/107; 313/353; 313/355

[58] Field of Search ..... 313/103 CM, 105 CM, 313/353, 355, 107

[56] References Cited

U.S. PATENT DOCUMENTS

| | | | |
|---|---|---|---|
| 3,346,752 | 10/1967 | Battson . | |
| 3,449,582 | 6/1969 | Sackinger | 313/107 X |
| 3,760,214 | 9/1973 | Yamazaki et al. | 313/107 X |
| 3,814,966 | 6/1974 | Misumi et al. | 313/408 |
| 4,023,063 | 5/1977 | King et al. | 313/105 CM X |
| 4,051,403 | 9/1977 | Feingold et al. | 313/105 CM |

FOREIGN PATENT DOCUMENTS

| | | | |
|---|---|---|---|
| 1434053 | 4/1976 | United Kingdom | 313/105 CM |
| 1458909 | 12/1976 | United Kingdom . | |

OTHER PUBLICATIONS

W. H. Kohl, *Handbook of Materials and Techniques for Vacuum Devices*, Reinhold Publishing Corp., pp. 569–571.

*Primary Examiner*—Palmer C. Demeo

*Attorney, Agent, or Firm*—Marc D. Schechter

[57] ABSTRACT

In a channel plate electron multiplier having a stack of perforated conducting sheet dynodes insulated from one another, electrons incident on the input face of the stack which do not enter the channels give rise to unwanted secondary electrons which move transverse to the channels in the space in front of the stack. These secondary electrons enter channels remote from the point of incidence and thereby degrade the definition and contrast of an electron image transmitted by the channel plate. A layer of material having a low secondary electron emission, which may be on a sheet carrier, is provided on the stack input face.

10 Claims, 3 Drawing Figures

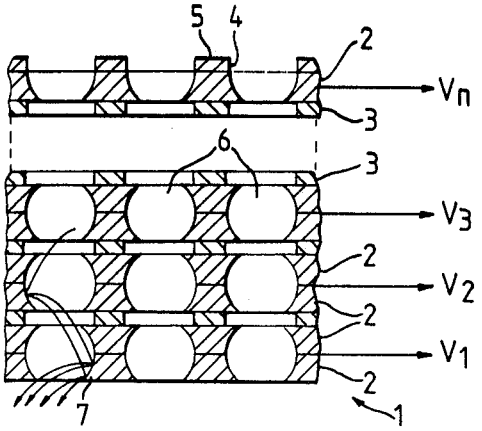
Fig.1(a)
Fig.1(b)
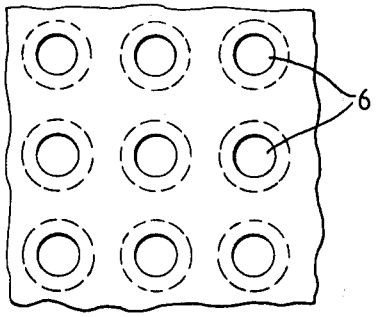
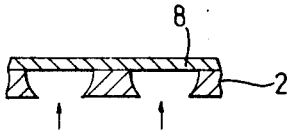
Fig.2.

CHANNEL PLATE ELECTRON MULTIPLIER

BACKGROUND OF THE INVENTION

This invention relates to electron multipliers and more particularly to electron multipliers of the channel plate type. The invention is applicable to channel plates for use in electronic imaging tube applications.

Herein, a channel plate is defined as a secondary-emissive electron-multiplier device comprising a stack of conducting sheet dynodes, insulated from one another, and having a large number of channels passing transversely through the stack. Each channel comprises aligned holes in the dynodes, and the walls of the holes are capable of secondary electron emission. In use, the dynodes are held at progressively increasing positive d.c. voltages from input to output. Electrons incident upon the wall of the hole of the input dynode of a channel give rise to an increased number of secondary electrons which pass down the channel to fall upon the wall of the hole of the next more positive dynode where further secondary emission multiplication occurs. This process is repeated down the length of each channel to give a greatly enhanced output electron current substantially proportional to the input current. Such channel plates and methods for manufacturing them are described in U.K. Patent Specification No. 1,434,053.

Channel plates may be used for intensification of electron images supplied either by the raster scan of the electron beam of a cathode ray tube or by a photocathode receiving a radiant image which excites photoelectrons which are fed as a corresponding electron image to the input face of the channel plate. In either event, electrons fall on the portions of the input face of the first dynode of the channel plate between the channels, exciting secondary electrons which, by reason of their spread in emission energy and direction, pursue trajectories in the space in front of the channel plate which carry them into channels remote from their point of origin. The contrast and definition of the image are degraded by each channel receiving additional input electrons in proportion to the original input electron density at channels over a range of distances away.

The sheet dynodes may be made from a metal alloy such as aluminum magnesium or copper beryllium which is subsequently activated by heating in an oxygen atmosphere to produce a surface all over the dynode which has a high secondary emission coefficient. The input face will thus have an undesirably high secondary emission leading to contrast degradation. Alternatively, the dynodes may be made from sheet steel coated with cryolite, for example, to give a secondary emission coefficient of 4 or 5. In this case it is also impractical to restrict the coating of cryolite to the insides of the holes and the input face will again have an undesirably high secondary emission coefficient.

Moving the channels closer together to minimize the flat surface between adjacent holes on the input face is unsatisfactory for a number of reasons. Firstly, the ratio of hole area to metal area is increased and the individual dynodes become flimsy and difficult to handle during plate manufacture. Secondly, since the most readily made channels have a circular cross-section, the flat area between channels could not be eliminated, even with the closest channel spacing. Finally, an important application of channel plate multipliers is to color display devices in which color selection takes place at the multiplier output. For example, a pair of selector electrodes may be provided on the output face of the stack, each electrode consisting of regularly spaced strips of conductor, the strips being in registration with lines of channels and lines of phosphor on the screen. The strips of the two selector electrodes are interdigitated and voltages are applied to the electrodes to deflect each of the channel output beams onto a selected phosphor. Such a color selection system is described in U.K. Pat. No. 1,458,909. Close channel spacing leaves less space for color selection electrodes and also less space on the screen for the corresponding pattern of phosphor stripes or dots.

SUMMARY OF THE INVENTION

It is an object of the invention to reduce the degradation of contrast and definition by reducing the unwanted secondary emission. To this end, the invention provides a channel plate electron multiplier comprising a stack of conducting sheet dynodes insulated from one another. Channels pass transversely through the stack. Each channel comprises aligned holes in the dynodes and the walls of the holes have secondary electron emissive surfaces. A layer of material having a secondary electron emission coefficient less than 2.0 is deposited on a carrier sheet placed in contact with the outermost surface of the input dynode. This carrier sheet has holes registering with the input dynode holes, and material lies between the holes in the carrier sheet.

The lower the secondary emission coefficient of the layer of material, the greater will be the improvement in contrast obtained. But if the low emission material had been provided directly on the face of the input dynode, it would have been difficult to provide the high emission material simultaneously on the walls of the holes since there would then be the risk that, during manufacture, low emission material would enter the channels and degrade their performance. The low emission material is therefore separately deposited on the carrier sheet which is subsequently placed in contact with the outermost surface of the input dynode.

The suppression of secondary emission in electronic devices which would otherwise interfere with the operation of the device is a subject which has been studied by various workers. A survey is given in "Handbook of Materials and Techniques for Vacuum Devices" by Walter H. Kohl (Reinhold Publishing Corp.) in Chapter 19, pages 569 to 571. It is known that the secondary emission coefficient of any optically black, microcrystalline layer is much smaller than that of a smooth coherent layer. Carbon in the form of graphite or soot has a low secondary emission coefficient, but either may be undesirable in a channel plate multiplier device since it may be difficult to prevent carbon particles from entering the channels. If only a few channels at random across the plate are degraded, the appearance of the intensified image in the case of an imaging device may be unacceptable. However, if the carbon is provided as an electron beam evaporated layer on the carrier sheet, a high density, strongly adherent carbon layer is obtained. Alternatively, the carbon layer may be applied by chemical vapor deposition.

BRIEF DESCRIPTION OF THE DRAWING

FIG. 1(*a*) shows part of a cross-section through the centers of one row of channels of a channel plate electron multiplier.

FIG. 1(*b*) shows part of a plan view of the channel plate of FIG. 1(*a*) looking into the output dynode.

FIG. 2 shows a cross-section through a half-dynode sheet masked for etching to produce a carrier sheet.

DESCRIPTION OF THE PREFERRED EMBODIMENTS

In FIG. 1(*a*), the section through the channel plate electron multiplier 1 shows dynodes made up of pairs of half-dynodes 2. The holes 6 in the dynodes are barrel-shaped for optimum dynode efficiency as described in U.K. Patent Specification No. 1,434,053. The half-barrel holes in the half-dynodes may be produced by etching, the wall of each tapered half-hole then being accessible for receiving evaporated layers which may be needed as part of the process of producing a high secondary emission layer in the hole. Pairs of half-dynodes 2 and perforated separators 3 are assembled as a stack. FIG. 1(*b*) shows an plan view of the stack of FIG. 1(*a*) looking into the output dynode. In use, potentials $V_1$, $V_2$, $V_3$, . . . $V_n$ are applied to the dynodes, $V_1$ being most positive relative to $V_n$, $V_2$ next most positive and so on. The difference between adjacent potentials is typically 300 volts. Schematic trajectories pursued by electrons in the multiplying process are shown at 7.

The first or input dynode, to which the potential $V_n$ is applied, is a single half-dynode arranged with the larger of the tapered hole diameters facing the incoming electrons. When this half-dynode is coated with secondary emitter, the flat faces are coated as well as the walls of the tapered holes. In principle the flat face might be masked during coating, but manufacture is eased if the masking operation can be avoided. Consequently, the flat face has the same, intentionally high, secondary emission coefficient as the walls of the holes.

Input electrons falling on the flat face of the input dynode will therefore give rise to substantial numbers of secondary electrons which, by reason of their initial energy and direction, will move out into the space in front of the input dynode. The electrostatic field in the space immediately in front of the input dynode will generally be low. For example in a cathode ray tube having a channel plate electron multiplier in front of a phosphor screen as described in U.K. Patent Specification No. 1,434,053, the field will be only weakly directed toward the channel plate input, since the acceleration of the electron beam of the cathode ray tube to its final velocity takes place some distance from the channel plate. Hence secondary electrons emitted from the face of the input dynode may be returned to the input dynode but only after pursuing trajectories which carry them laterally across the input dynode. Such electrons may then enter channels remote from their point of origin. The contrast and definition of an electron image transmitted by the channel plate are then degraded by each channel receiving additional input electrons in proportion to the original input electron density at channels over a range of distances away.

To mask the flat face during operation of the multiplier and to reduce the effective secondary emission coefficient as much as possible, according to the invention a carrier sheet 4 is placed over the flat face of the first dynode. The carrier sheet 4 has holes which are aligned with those of the first dynode and which therefore leave the input apertures of the first dynode unobstructed. The solid portions of the carrier sheet mask substantially all of the flat face of the first dynode.

The outermost surface of the carrier sheet 4 has a layer 5 of electron beam evaporated carbon. Such a layer is produced by heating a carbon block in a vacuum by electron beam bombardment to a very high temperature in the presence of the carrier sheet alone. The carbon is then evaporated onto the carrier sheet to produce a high density, strongly adherent carbon layer having a secondary electron emission coefficient of 0.8 to 1.3. While this layer does not have as low a coefficient as soot or powdered graphite, it is mechanically far more rugged than either of these two materials, and has a coefficient sufficiently low compared to that of, for example, cryolite which may be used on the walls of the holes and which may have a coefficient between 4 and 5.

The use of a carrier sheet for the layer of low emission material has the advantage separating the choice of material and method of application of the high emission material from those of the low emission material.

It is of importance that the holes in the carrier sheet should be in accurate register with those of the input dynode all over the input surface of the stack. To achieve this, a half-dynode may be used as the starting point for the carrier sheet manufacture. The half-dynodes themselves are typically manufactured from sheet mild steel in which the holes are photochemically etched from a master to ensure that corresponding holes on a stack of dynodes will be in register with one another. Referring to FIG. 2, a perforated half-dynode 2, uncoated with the secondary emitting layer, is marked with a film 8 of self-adhesive plastic material on the side having the large diameter apertures and is then etched to increase the diameter of the small apertures to substantially equal that of the large apertures and to reduce its thickness. The film is then removed and the carbon layer applied to one surface of the carrier sheet by electron beam evaporation.

We claim:

1. A channel plate electron multiplier comprising, a stack of conducting sheet dynodes insulated from one another, channels passing transversely through the stack, each channel comprising aligned holes in the dynodes and the walls of the holes having a secondary electron emissive surface, and a layer of material having a secondary electron emission coefficient less than 2.0 deposited on a carrier sheet placed in contact with the outermost surface of the input dynode, said carrier sheet having holes registering with the input dynode holes, and said material lying between the holes in said carrier sheet.

2. A channel plate electron multipler as claimed in claim 1, wherein each dynode other than the input dynode comprises a pair of half-dynodes in contact, the holes in each half-dynode having a larger diameter aperture on one side of the half-dynode sheet than on the ohter side and the larger diameter apertures of the pair of half-dynodes facing one another in said pair, and wherein the input dynode comprises a single half-dynode arranged with the larger diameter apertures facing toward.

3. A channel plate electron multiplier as claimed in claim 1 or 2 wherein said material layer is carbon.

4. A channel plate electron multiplier as claimed in claim 3 wherein the carbon layer is provided as an electron beam evaporated layer on said carrier sheet.

5. A channel plate electron multiplier as claimed in claim 2 wherein the carrier sheet comprises a perforate half-dynode in which the smaller diameter holes have been etched to increase their size to that of the larger diameter holes, said material layer then being applied to one side of the carrier sheet.

6. A channel plate electron multiplier as claimed in claim 5, wherein the material layer is carbon and is applied by electron beam evaporation.

7. A channel plate electron multiplier as claimed in claim 5 wherein the material layer is carbon and is applied by chemical vapor deposition.

8. A channel plate electron multiplier comprising:

a stack of conducting sheet dynodes insulated from one another, said stack having two opposite ends, a dynode at one end being an input dynode and a dynode at the other end being an output dynode, said input dynode having an outer surface directed away from the dynode stack, each of said dynodes having a plurality of holes therethrough, said holes in said dynodes being aligned to form a plurality of channels which pass through the dynode stack, said holes being bounded by walls having secondary electron-emissive surfaces;

a carrier sheet arranged on and in contact with the outer surface of the input dynode, said carrier sheet having an outer surface directed away from the input dynode, said carrier sheet having a plurality of holes therethrough, said holes being in alignment with the holes in the input dynode; and a layer of material having a secondary electron emission coefficient less than 2.0 provided on and covering the outer surface of the carrier sheet, but not covering the holes in the carrier sheet.

9. A channel plate electron multiplier as claimed in claim 8, characterized in that:

each dynode other than the input dynode comprises a pair of half-dynodes, each half-dynode having first and second sides and having a plurality of holes therethrough, each hole having a larger diameter at the first side than at the second side of the half-dynode, each half-dynode in each pair contacting the other half-dynode of the pair on its first side; and the input dynode comprises a single half-dynode having its first side directed away from the dynode stack.

10. A channel plate electron multiplier as claimed in claim 9, characterized in that the carrier sheet is made by the steps of:

providing a half-dynode having first and second sides and plurality of holes therethrough, each hole having a larger diameter at the first side than at the second side of the half-dynode, the diameter of each hole being tapered from the first to the second side to form a concave inner surface;

selectively etching the half-dynode to make the diameter of each hole substantially uniform and equal to the diameter at the first side of the half-dynode; and applying a layer of a material having a secondary electron emission coefficient less than 2.0 on one side of the etched half-dynode.

* * * * *

UNITED STATES PATENT AND TRADEMARK OFFICE

CERTIFICATE OF CORRECTION

PATENT NO. : 4,422,005

DATED : December 20, 1983

INVENTOR(S) : DEREK WASHINGTON ET AL

It is certified that error appears in the above-identified patent and that said Letters Patent is hereby corrected as shown below:

In the claims:

Claim 2, line 6 (column 4, line 56), change "ohter" to --other--;

Claim 2, line 10 (column 4, line 60), change "toward" to --outward--.

Signed and Sealed this

*Seventeenth* Day of *July 1984*

[SEAL]

*Attest:*

GERALD J. MOSSINGHOFF

*Attesting Officer*

*Commissioner of Patents and Trademarks*